US010625898B2

(12) United States Patent
Hodge et al.

(10) Patent No.: US 10,625,898 B2
(45) Date of Patent: Apr. 21, 2020

(54) BREAK PACK CONTAINER

(71) Applicant: Walmart Apollo, LLC, Bentonville, AR (US)

(72) Inventors: Shawn Morris Hodge, Bentonville, AR (US); Matthew David Alexander, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/994,279

(22) Filed: May 31, 2018

(65) Prior Publication Data

US 2018/0354674 A1 Dec. 13, 2018

Related U.S. Application Data

(60) Provisional application No. 62/517,224, filed on Jun. 9, 2017.

(51) Int. Cl.

| | |
|---|---|
| ***B65D 5/02*** | (2006.01) |
| ***B65D 5/42*** | (2006.01) |
| ***B65D 5/10*** | (2006.01) |
| ***B65D 5/36*** | (2006.01) |
| *B65D 5/00* | (2006.01) |

(52) U.S. Cl.

CPC ..... *B65D 5/0254* (2013.01); *B65D 5/0263* (2013.01); *B65D 5/103* (2013.01); *B65D 5/3621* (2013.01); *B65D 5/4266* (2013.01); *B65D 5/001* (2013.01)

(58) Field of Classification Search

CPC .... B65D 5/0254; B65D 5/001; B65D 5/4266; B65D 5/3621; B65D 5/10

USPC ..... 229/142, 117, 140, 149, 183, 178, 155, 229/185, 117.01, 148, 152, 174, 194; 206/170, 45.29

See application file for complete search history.

(56) References Cited

U.S. PATENT DOCUMENTS 2,339,691 A 1/1944 Fellowes
4,230,261 A * 10/1980 Austin ..... B65D 5/3621 229/114

(Continued)

OTHER PUBLICATIONS

Papermart, Tab Lock Folder Mailing Boxes, http://www.addthis.com/bookmark.php?v=250, last viewed Mar. 30, 2017.

(Continued)

*Primary Examiner* — Christopher R Demeree

(74) *Attorney, Agent, or Firm* — McCarter & English, LLP; David R. Burns

(57) ABSTRACT

An example blank for a break pack container is described. The blank includes first and second fold lines extending across at least a portion of a sheet of cardboard material. The blank includes wall portions bounded by the first and second fold lines, one of the wall portions including a first perforated section or cutout formed between the first and second fold lines. The blank includes a first top flap extending from the first fold line, the first top flap including first and second opposing ends, the first end of the first top flap including a first side flap connected to the first top flap by a third fold line. The first side flap is configured to be folded over a wall portion and inserted into the first perforated section or cutout when the sheet of cardboard material is folded into the assembled configuration.

18 Claims, 7 Drawing Sheets

(56) References Cited

U.S. PATENT DOCUMENTS

| | | | | |
|---|---|---|---|---|
| 4,497,433 | A * | 2/1985 | Wischusen, III | B65D 5/064 206/562 |
| 4,530,459 | A * | 7/1985 | Maroszek | B65D 5/46096 229/117.12 |
| 4,535,928 | A * | 8/1985 | Capo | B65D 81/368 206/224 |
| 4,969,596 | A * | 11/1990 | Schulbaum | A61B 50/37 229/117.27 |
| 5,579,990 | A * | 12/1996 | Durand | B65D 5/10 229/120.05 |
| 6,409,077 | B1 * | 6/2002 | Telesca | B65D 5/5007 206/45.29 |
| 9,469,431 | B2 | 10/2016 | Benigni et al. | |

OTHER PUBLICATIONS

W.E. Plemons Machinary Services, Inc., Tray Box Former, Box Illustration, Illustration #7C Tray With Tuck in Flaps, <http://www.weplemons.com/assets/documents/traySimple/7C.pdf>, last viewed Mar. 30, 2017.

International Fibreboard Case Code (0227), <http://www.fefco.org/sites/default/files/files/FEFCO_ESBO_codes_of_designs.pdf>, 2007.

Yebo!, Custom Boxes and Packaging, Self Seal/Tear Box, http://www.customboxesandpackaging.com/selfsealtearstripmailerbox/, last viewed Mar. 27, 2017.

New York Label & BoxWorks, Standard Reverse Tuck (SRT), Since1878.com (index.php), <http://www.since1878.com/carton-styles-details.php?styleID=1201>, 2007.

Cardboard Box Styles—Custom Cartons, RSC—Regular Slotted Carton, http://www.customcartons.co.nz/boxstyles/, last viewed Mar. 30, 2017.

* cited by examiner

BREAK PACK CONTAINER

CROSS-REFERENCE TO RELATED APPLICATIONS

This application claims the benefit of commonly assigned U.S. Provisional Patent Application No. 62/517,224, which was filed on Jun. 9, 2017. The entire content of the foregoing provisional patent application is incorporated herein by reference.

BACKGROUND

Conventional break pack containers often fail to provide sufficient support when stacked on top of each other, resulting in collapse of the break pack container and potential damage to contents of the break pack container.

SUMMARY

Exemplary embodiments of the present disclosure provide a blank for a break pack container that can be folded into an assembled configuration from a collapsed configuration. In some embodiments, the break pack container includes two top flaps, each top flap including a side flap that is configured to be folded and inserted into a perforated section or cutout in a side wall of the break pack. In some embodiments, the break pack container includes one top flap including side flaps on opposing ends configured to be folded and inserted into perforated sections or cutouts on opposing side walls of the break pack. Such engagement between the side flaps and the perforated sections or cutouts results in an overlap of the top flap(s) with each other and the side walls, providing a more rigid top surface. The exemplary break packs can therefore be stacked on top of each other without collapsing.

In accordance with embodiments of the present disclosure, an exemplary blank for a break pack container is provided. The blank includes a sheet of cardboard material having a first end and a second opposing end, the sheet of cardboard material can be configured to be folded into an assembled configuration from a collapsed configuration. The blank includes a first fold line extending across at least a portion of the sheet of cardboard material. The blank includes a second fold line extending across at least a portion of the sheet of cardboard material. The blank includes wall portions bounded by the first and second fold lines, one of the wall portions including a first perforated section or cutout formed between the first and second fold lines. The blank includes a first top flap extending from the first fold line, the first top flap including first and second opposing ends. The first end of the first top flap includes a first side flap connected to the first top flap by a third fold line. The first side flap is configured to be folded over a wall portion and inserted into the first perforated section or cutout when the sheet of cardboard material is folded into the assembled configuration.

The second fold line can be substantially parallel to and spaced from the first fold line. The first and second ends of the sheet of cardboard material are operatively coupled to each other to form a container body with an interior area. One of the wall portions can include a second perforated section or cutout formed between the first and second fold lines. The blank includes a second top flap extending from the first fold line, the second top flap including first and second opposing ends. In some embodiments, the first end of the second top flap includes a second side flap connected to the second top flap by a fourth fold line.

The second side flap is configured to be folded over a wall portion and inserted into the second perforated section or cutout when the sheet of cardboard material is folded into the assembled configuration. In the assembled configuration, the first and second side flaps are disposed on opposing sides of the break pack container. The second end of the first top flap includes a second side flap connected to the first top flap by a fourth fold line. The second side flap is configured to be folded over a wall portion and inserted into the second perorated section or cutout when the sheet of cardboard material is folded into the assembled configuration.

The first side flap can be connected to the first top flap by the third fold line and connected to the first fold line by a fourth fold line. The blank includes a plurality of flaps extending from the second fold line, the plurality of flaps can be configured to fold and engage to form a bottom surface of the break pack container in the assembled configuration. The first perforated line or cutout can be angled (e.g., not parallel or perpendicular) relative to the first and second fold lines.

In accordance with embodiments of the present disclosure, an exemplary break pack container is provided. The container includes wall portions that form a container body with an interior area. The wall portions define a top perimeter and an opposing bottom perimeter. The wall portions include a first side wall with a first perforated section or cutout formed in the first side wall between the top and bottom perimeters, and a second side wall with a second perforated section or cutout formed in the second side wall between the top and bottom perimeters. The container includes a first top flap extending from the top perimeter, the first top flap including first and second opposing ends, and the first end of the first top flap including a first side flap connected to the first top flap by a first fold line. The first top flap is configured to be folded over the interior area to form a top portion of the break pack container. The first side flap is configured to be folded over the first side wall and inserted into the first perforated section or cutout to maintain the position of the first top flap.

The container includes a second top flap extending from the top perimeter on an opposing side from the first top flap. The second top flap includes first and second opposing ends, and the first end of the second top flap includes a second side flap connected to the second top flap by a second fold line. The second top flap is configured to be folded over the first top flap. The second side flap is configured to be folded over the second side wall and inserted into the second perforated section or cutout to maintain the position of the second top flap. The first and second side flaps are disposed on opposing sides of the break pack container.

In some embodiments, the second end of the first top flap includes a second side flap connected to the first top flap by a second fold line. The second side flap is configured to be folded over the second side wall and inserted into the second perforated section or cutout to maintain the position of the first top flap. The first side flap is connected to the first top flap by the first fold line and connected to the top perimeter by a second fold line.

In accordance with embodiments of the present disclosure, an exemplary method of forming a blank for a break pack container is provided. The method includes providing a blank including a sheet of cardboard material having a first end and a second opposing end, the sheet of cardboard material configured to be folded into an assembled configuration from a collapsed configuration. The method includes forming a first fold line extending across at least a portion of the sheet of cardboard material. The method includes forming a second fold line extending across at least a portion of the sheet of cardboard material. The method includes forming a first perforated section or cutout between the first and second fold lines in one wall portion bounded by the first and second fold lines. The method includes forming a first top flap extending from the first fold line, the first top flap including first and second opposing ends, and the first end of the first top flap including a first side flap connected to the first top flap by a third fold line. The method includes folding the first side flap over a wall portion and inserting the first side flap into the first perforated section or cutout.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the break pack container, reference is made to the accompanying figures, wherein.

DETAILED DESCRIPTION

Exemplary embodiments of the present disclosure provide a break pack container that can be folded into an assembled configuration from a collapsed configuration. In some embodiments, the break pack container includes two top flaps, each top flap including a side flap that is configured to be folded and inserted into a perforated section or cutout in a side wall of the break pack. The side flaps overlap the top perimeter of the walls of the container and tuck into the respective perforated sections or cutouts. Such overlap provides structural support to the top flaps. The top flaps also overlap each other to provide additional structural support. In some embodiments, the break pack container includes one top flap including side flaps on opposing ends configured to be folded and inserted into perforated sections or cutouts on opposing side walls of the break pack. The side flaps overlap the top perimeter of the walls of the container, thereby providing structural support to one top flap. The top flap further overlaps a second top flap (without side flaps), thereby providing additional structural support to the container. Such engagement between the side flaps and the perforated sections or cutouts and the overlap of the top flaps provides a more rigid top surface. The exemplary break packs can therefore be stacked on top of each other without collapsing.

Figure 1:
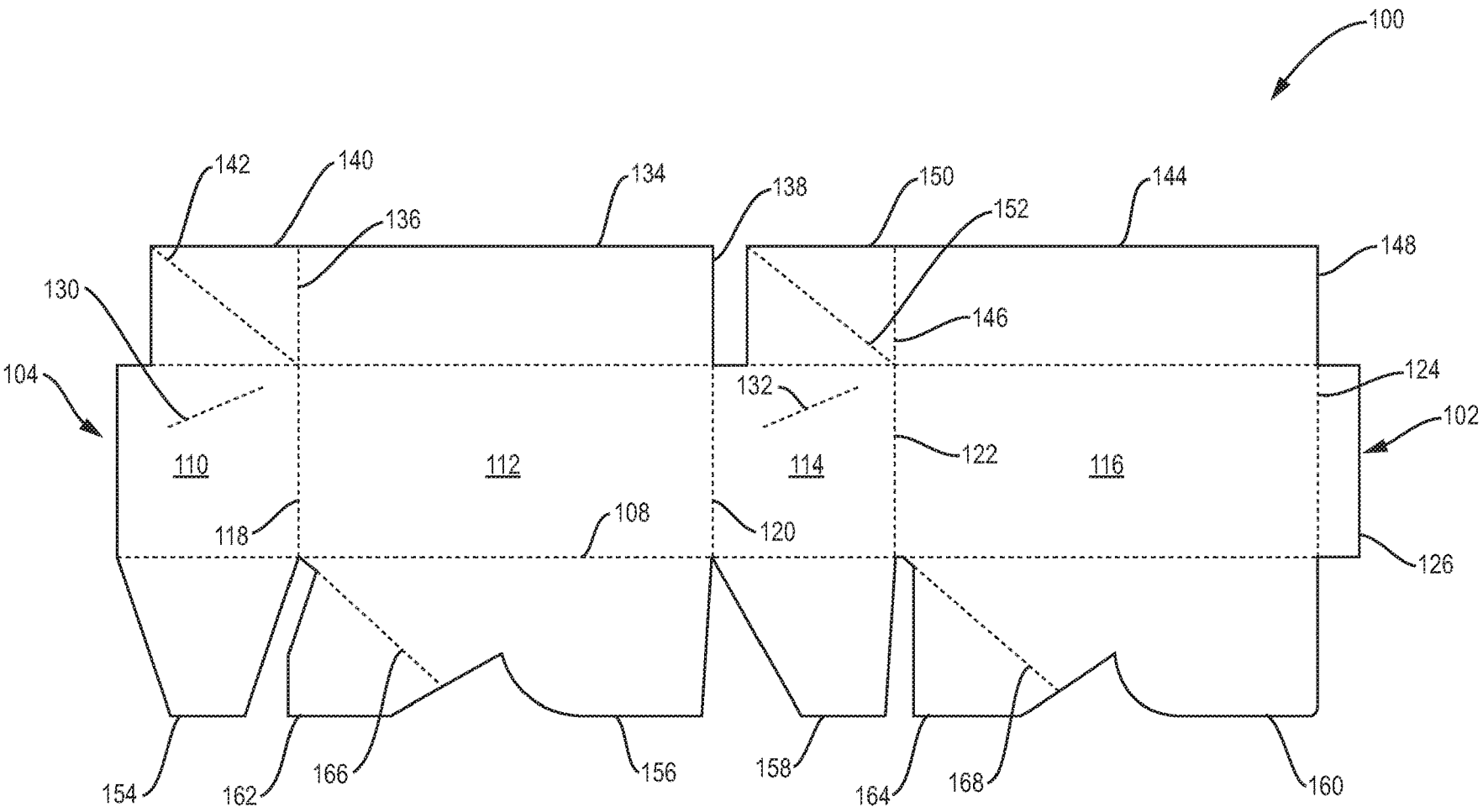
FIG. 1 is diagrammatic view of an exemplary blank for a break pack container of the present disclosure in a collapsed configuration.
Figure 2:
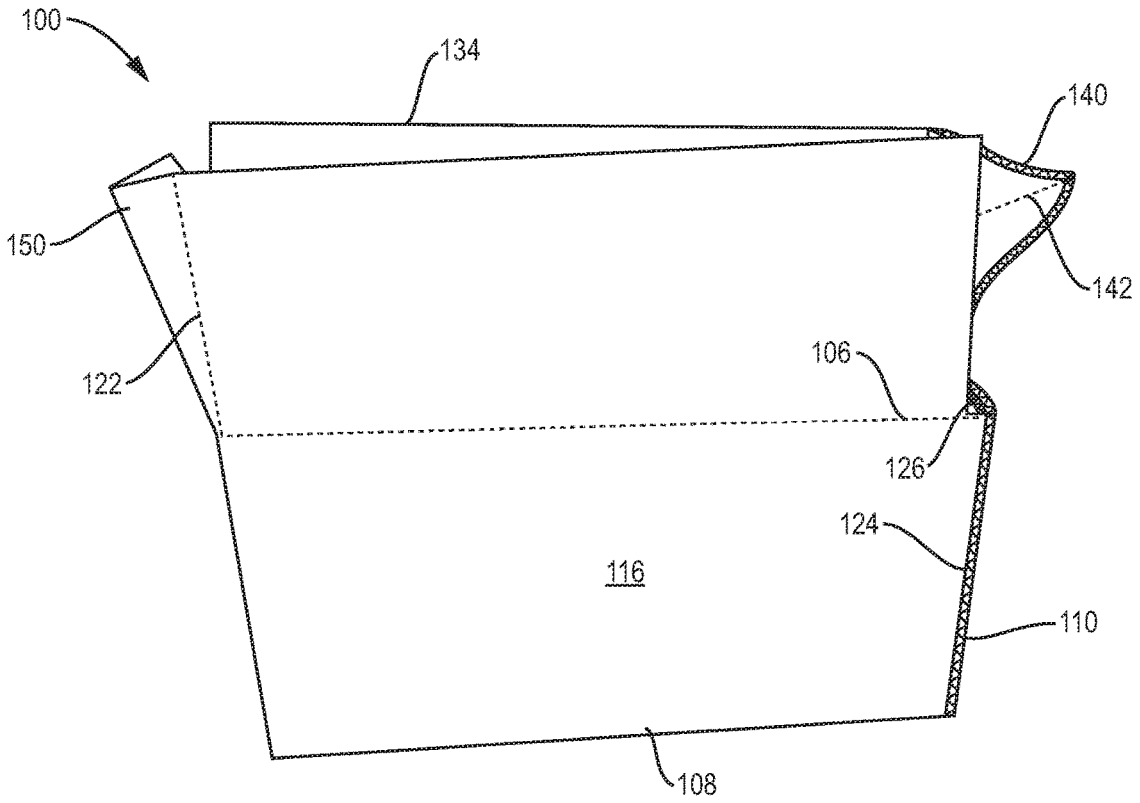
FIG. 2 is a front view of an exemplary blank for a break pack container in a partially assembled configuration.

FIG. 1 is a schematic diagram of a blank for a break pack container 100 (hereinafter "container 100") of the present disclosure. The container 100 can be formed from a single sheet of material, such as corrugate cardboard, and can be folded into an assembled configuration from a collapsed configuration. As will be discussed in greater detail below, the container 100 has fold lines and flaps that can be used to assemble the container 100 into a box-like shape capable of receiving items.

The container 100 includes a first end 102 and a second end 104. The container 100 includes a first fold line 106 formed in the container 100 and extending across the container 100 between the first and second ends 102, 104. The first fold line 106 can be substantially perpendicular to the first and second ends 102, 104. The container 100 includes a second fold line 108 formed in the container 100 extending across the container 100 between the first and second ends 102, 104. The second fold line 108 is spaced from and substantially parallel to the first fold line 106.

The container 100 includes multiple side wall portions 110-116 bounded by the first and second fold lines 106, 108. Each of the wall portions 110-116 can be substantially rectangular or square in shape. In particular, the container 100 includes a fold line 118 extending between and substantially perpendicularly to the first and second fold lines 106, 108 that separates the wall portion 110 from the wall portion 112. The container 100 includes a fold line 120 spaced from and substantially parallel to the fold line 118 that separates the wall portion 112 from the wall portion 114. The container 100 includes a fold line 122 spaced from and substantially parallel to the fold line 120 that separates the wall portion 114 from the wall portion 116.

Figure 3:
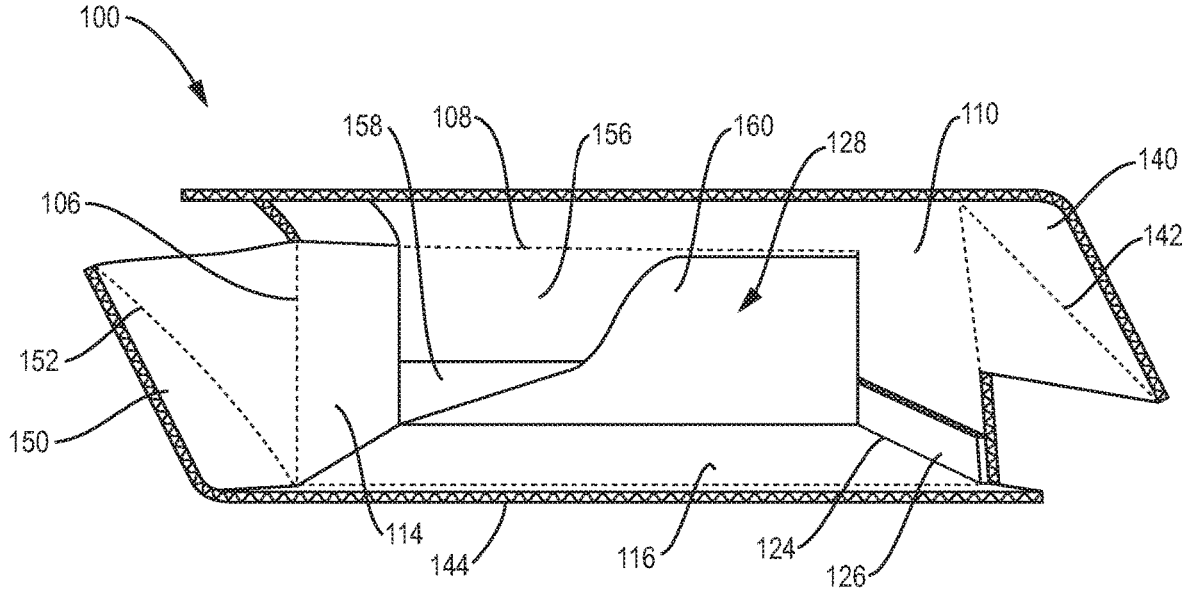
FIG. 3 is a top view of an exemplary blank for a break pack container in a partially assembled configuration.
Figure 4:
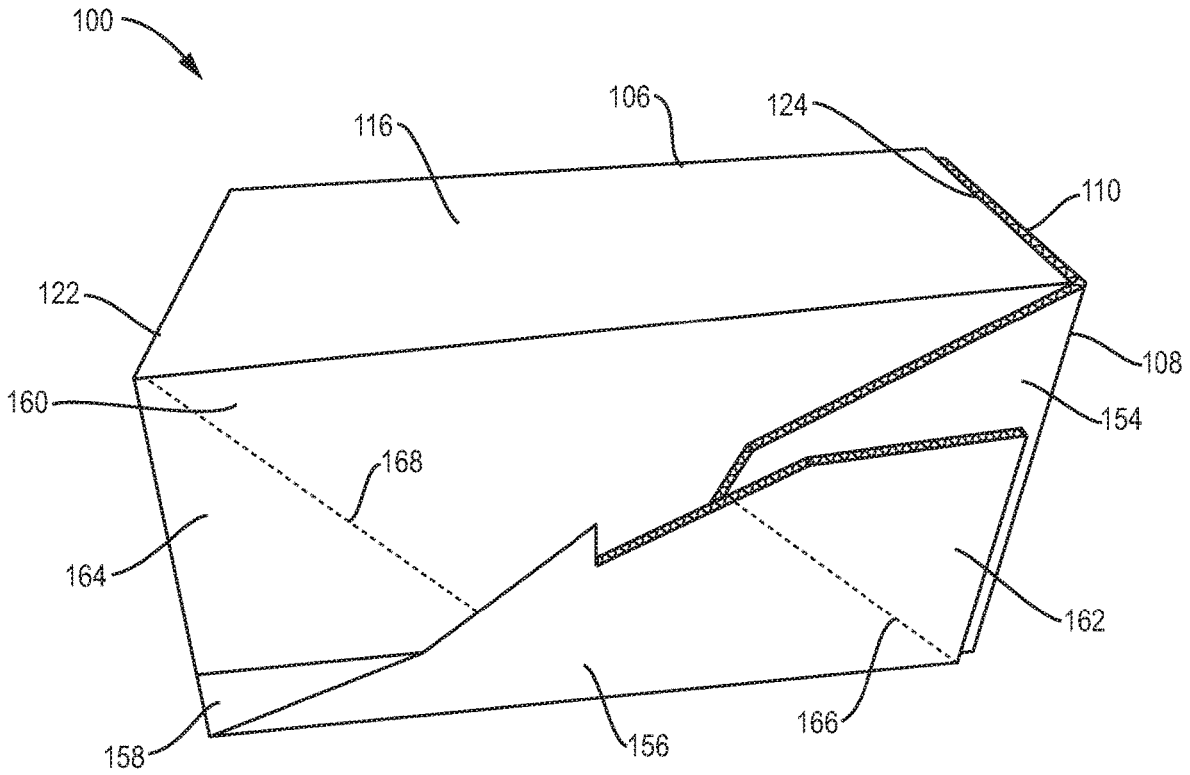
FIG. 4 is a bottom view of an exemplary blank for a break pack container in a partially assembled configuration.

The container 100 includes a fold line 124 spaced from and substantially parallel to the fold line 122 that defines a flap 126 to the first end 102 of the container 100. The flap 126 can be substantially rectangular in shape. Upon bending the container 100 at the fold lines 118-124, the flap 126 can be coupled with the second end 104 via a fastener, such as adhesive, staples, tape, or the like. Coupling the first and second ends 102, 104 forms a container body with an interior area 128 (see, e.g., FIG. 3). It should be understood that with the first and second ends 102, 104 coupled to each other, the fold line 106 defines a top perimeter of the container 100 and the fold line 108 defines a bottom perimeter of the container 100.

The container 100 includes section 130 (e.g., a perforated section, a cutout, or the like) formed in the wall portion 110 between the first and second fold lines 106, 108. In some embodiments, the section 130 can be formed as a perforated section that can be punched out by the user to form a cutout during assembly of the container 100. In some embodiments, the section 130 can be spaced closer to the first fold line 106 than the second fold line 108. In some embodiments, the section 130 can extend substantially parallel to the first fold line 106.

In some embodiments, the section 130 can extend at an angle relative to the first fold line 106 (e.g., with the end of the section 130 furthest from the second end 104 disposed closer to the first fold line 106 than the end of the section 130 closest to the second end 104). In some embodiments, the angle of the section 130 relative to the first fold line 106 can be between, e.g., approximately zero to 15°, approximately zero to 25°, approximately zero to 35°, approximately zero to 45°, or the like. The container 100 includes a section 132 substantially similar to the section 130 formed in the wall portion 114 between the first and second fold lines 106, 108. In some embodiments, the length, position and/or angle of the section 132 can be substantially similar to the section 130.

The container 100 includes a first top flap 134 operatively connected to the wall portion 112 at the first fold line 106. For example, the top flap 134 can be integrally formed with and extend from the wall portion 112, where the fold line 106 defines a boundary between the top flap 134 and the wall portion 112. The top flap 134 can be substantially rectangular in shape. The first top flap 134 includes first and second opposing ends 136, 138. The second end 138 can extend substantially in line with the fold line 120. The first end 136 can extend substantially in line with the fold line 118. The first end 136 is operatively coupled to a first side flap 140 at the fold line 118. In particular, the fold line 118 extends from the second fold line 108 to the top edge of the top flap 134 and/or side flap 140. The side flap 140 can be substantially square or rectangular in shape. In exemplary embodiments, the side flap 140 can be integrally formed with and extend from the top flap 134, where the fold line 118 defines the boundary between the side flap 140 and the top flap 134.

The side flap 140 is also operatively coupled to the wall portion 110 at the fold line 106. In exemplary embodiments, the side flap 140 can be integrally formed with and extend from the wall portion 110, where the fold line 106 defines the boundary between the side flap 140 and the wall portion 110. While the side flap 140 has been described as being operatively connected to the wall portion 110, in exemplary embodiment of the present disclosure the side flap 140 can be separate from the wall portion such that the side flap 140 and the wall portion 110 are not connected. The side flap 140 includes a fold line 142 extending diagonally from the intersection of the fold lines 106, 118 to the opposing corner of the side flap 140. The side flap 140 extends only a partial width of the wall section 110 and is therefore spaced from the second end 104. As will be discussed below, during assembly the side flap 140 can fold at the fold lines 106, 136, 142 to form a generally triangular structure that is inserted into the section 130 to engage the top flap 134 with the wall portion 110.

The container 100 includes a second top flap 144 substantially similar to the first top flap 134. The top flap 144 can be substantially rectangular in shape. The top flap 144 is operatively connected to the wall portion 116 at the first fold line 106. For example, the top flap 144 can be integrally formed with and extend from the wall portion 116, where the fold line 106 defines a boundary between the top flap and the wall portion 116. The top flap 144 includes first and second opposing ends 146, 148. The second end 148 can extend substantially in line with the fold line 124. The first end 146 can extend substantially in line with the fold line 122. The first end 146 is operatively coupled to a second side flap 150 at the fold line 122. In particular, the fold line 122 extends from the second fold line 108 to the top edge of the top flap 144 and/or side flap 150. The side flap 150 can be substantially rectangular or square in shape. In exemplary embodiments, the side flap 150 can integrally formed with and extend from the top flap 144, where the fold line 122 defines the boundary between the side flap 150 and the top flap 144.

The side flap 150 is also operatively coupled to the wall portion 114 at the fold line 106. In exemplary embodiments, the side flap 150 can be integrally formed with and extend from the wall portion 114, where the fold line 106 defines the boundary between the side flap 150 and the wall portion 114. While the side flap 150 has been described as being operatively connected to the wall portion 114, in exemplary embodiment of the present disclosure the side flap 150 can be separate from the wall portion such that the side flap 150 and the wall portion 114 are not connected. The side flap 150 includes a fold line 152 extending diagonally from the intersection of the fold lines 106, 122 to the opposing corner of the side flap 150. The side flap 150 extends only a partial width of the wall section 114 and is therefore spaced from the top flap 134. As will be discussed below, during assembly the side flap 150 can fold at the fold lines 106, 146, 152 to form a generally triangular structure that is inserted into the section 132 to engage the top flap 144 with the wall portion 114.

The container 100 includes bottom flaps 154-160 operatively connected to the respective wall portions 110-116 at the fold line 108. In particular, bottom flap 154 is operatively connected to the wall portion 110, bottom flap 156 is operatively connected to the wall portion 112, bottom flap 158 is operatively connected to the wall portion 114, and bottom flap 160 is operatively connected to the wall portion 116. The bottom flaps 154, 158 can be substantially trapezoidal in configuration. The bottom flaps 156, 160 can be irregularly shaped with side ends substantially parallel to the fold lines 118-124. Each of the bottom flaps 156, 160 includes a locking tab 162, 164 operatively connected at a fold line 166, 168. The bottom flaps 154-160 can be engaged to form a bottom surface of the container 100 in the assembled configuration. The container 100 can therefore be assembled to house multiple items, and the bottom flaps 154-160 can be disengaged to return the container 100 into the collapsed configuration for storage.

FIGS. 2-5 show front, top, bottom and side views of the container 100 in a partially assembled configuration. In particular, the first and second ends 102, 104 have been coupled, and the bottom flaps 154-160 have been interlockingly engaged to form the bottom surface of the container 100. In particular, the flaps 154-160 and the locking tabs 162, 164 have been interlocked to prevent undesired separation of the bottom flaps 154-160.

Figure 5:
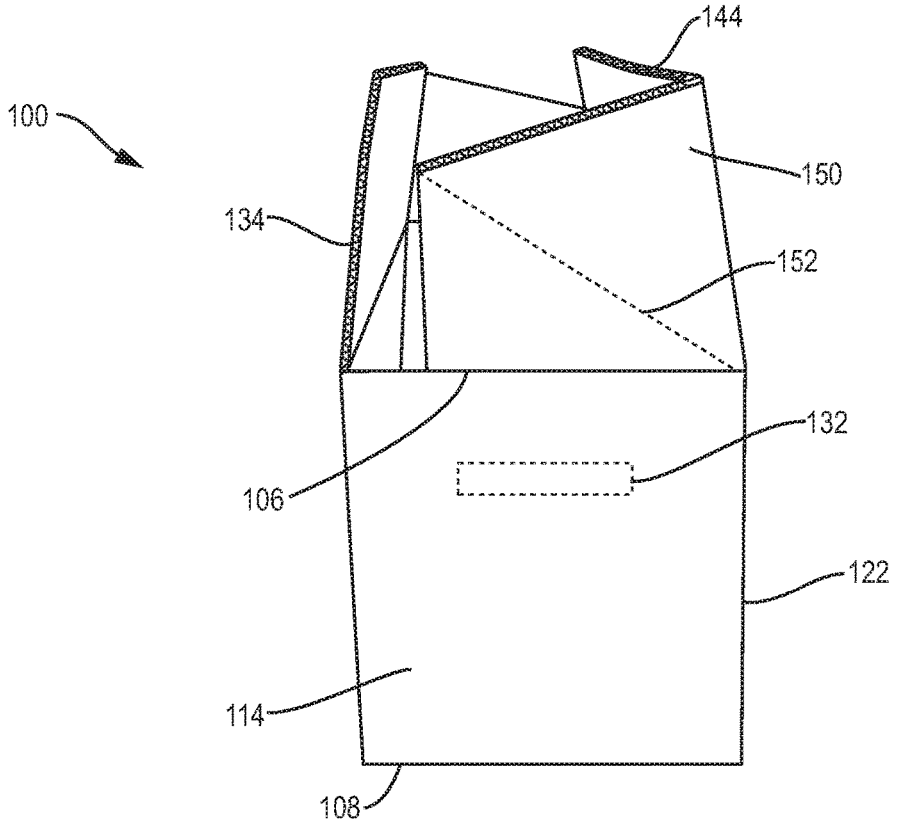
FIG. 5 is a side view of an exemplary blank for a break pack container in a partially assembled configuration.

As shown in FIG. 5, the side flap 150 can be folded at the fold line 106 relative to the wall portion 114 and folded at the fold line 122 relative to the top flap 144. The side flap 150 can further be folded outwardly (e.g., away from the interior area 128) or inwardly (e.g., towards the interior area 128) at the diagonal fold line 152 to form a generally triangular structure with the side flap 150. The side flap 140 can similarly be folded at the fold line 106 relative to the wall portion 110 and folded at the fold line 118 relative to the top flap 134. The side flap 140 can further be folded outwardly or inwardly at the diagonal fold line 142 to form a generally triangular structure with the side flap 140.

Figure 6:
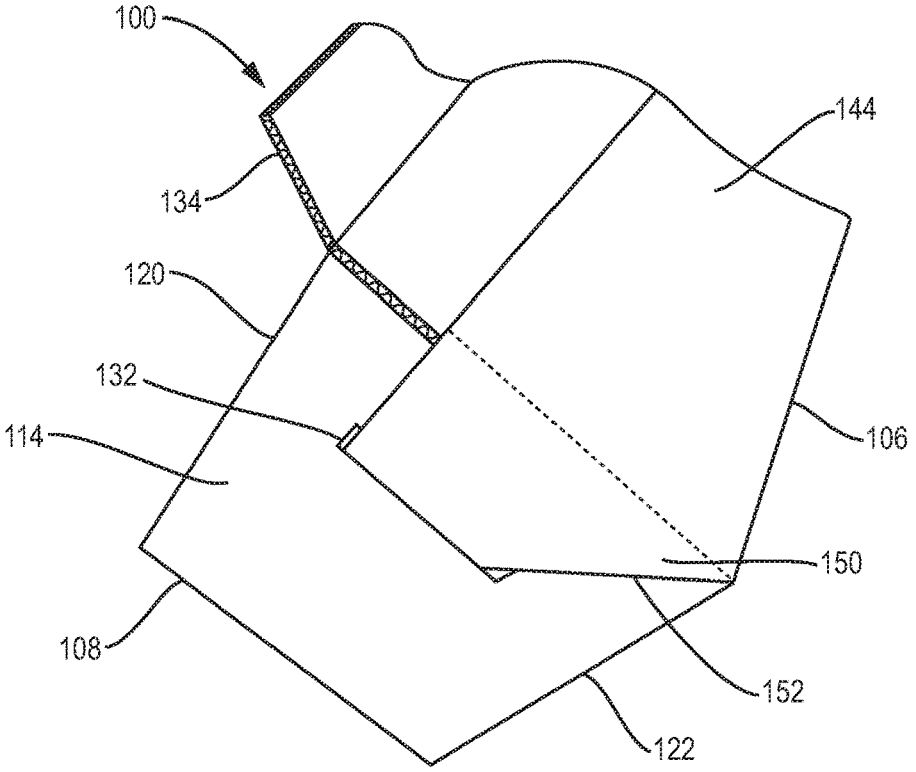
FIG. 6 is a perspective top view of an exemplary blank for a break pack container in a partially assembled configuration, including a side flap inserted into a cutout.
Figure 7:
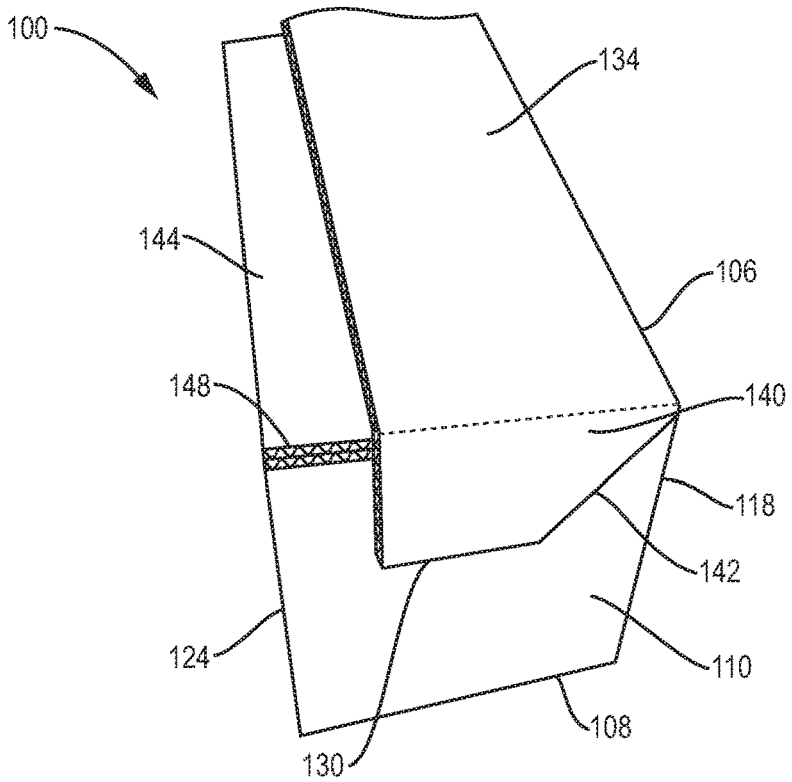
FIG. 7 is a perspective top view of an exemplary blank for a break pack container in an assembled configuration, including both side flaps inserted into respective cutouts.
Figure 8:
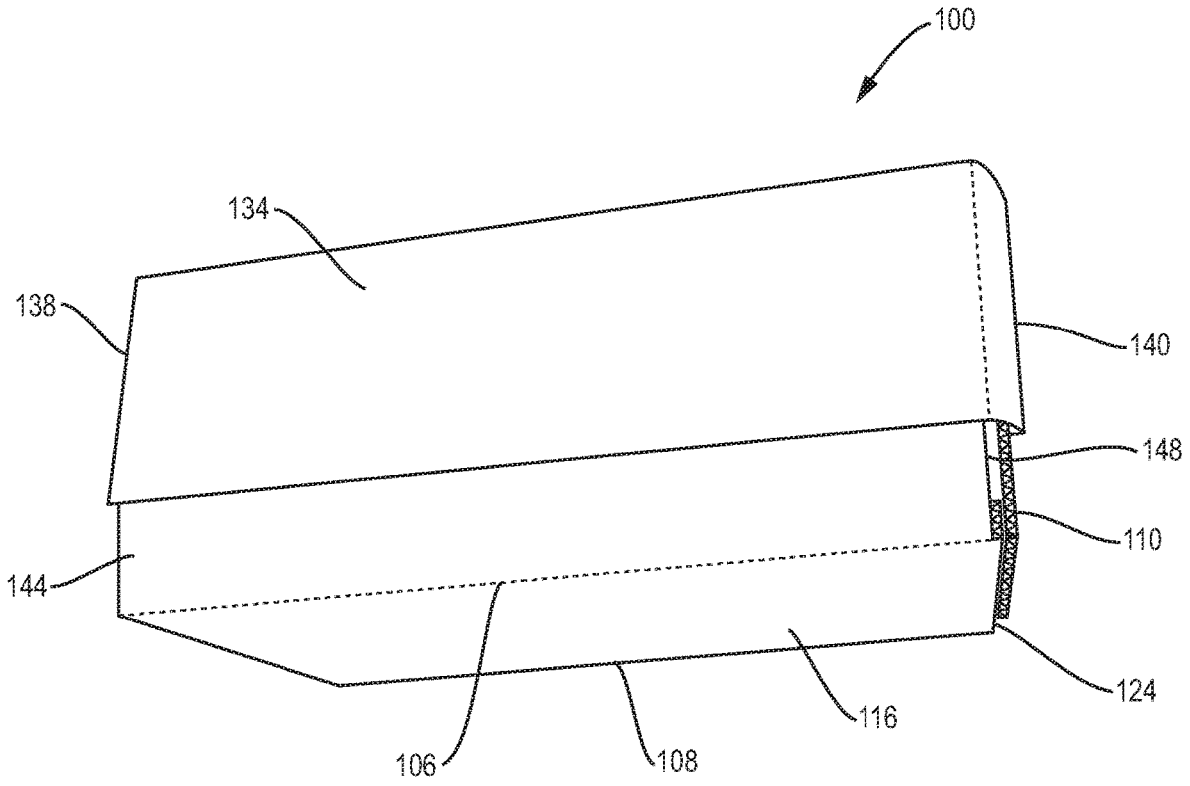
FIG. 8 is a perspective top view of an exemplary blank for a break pack container in an assembled configuration, including both side flaps inserted into respective cutouts.

To fully assembly the container 100, the top flaps 134, 144 are sequentially folded over the interior area 128 as shown in FIGS. 6-8. Although illustrated as first folding top flap 144 and subsequently folding top flap 134, it should be understood that top flap 134 can be folded over the interior area 128 first. As the top flap 144 is folded over the interior area 128 at the fold line 106, the side flap 150 is further folded along the fold line 152 (e.g., folding the side flap 150 in half), resulting in a substantially triangular configuration of the side flap 150. As shown in FIG. 6, the endpoint of the side flap 150 (i.e. the free corner/vertex of the triangular configuration) is tucked into or inserted into the section 132 to interlock the side flap 150 with the section 132. The intersection between the top flap 144 and the side flap 150 (e.g., along fold line 122) abuts the top perimeter of the container 100, thereby providing structural support to the top flap 144. Engagement of the side flap 150 with the section 132 provides additional structural support to the top flap 144.

After the top flap 144 has been folded over and the side flap 150 has been engaged with the section 132, the top flap 134 is folded over the interior area 128 and the top flap 144. As the top flap 134 is folded over the interior area 128 at the fold line 106, the side flap 140 is further folded along the fold line 142 (e.g., folding the side flap 140 in half), resulting in a substantially triangular configuration of the side flap 140. As shown in FIG. 7, the endpoint of the side flap 140 (i.e. the free corner/vertex of the triangular configuration) is tucked into or inserted into the section 130 to interlock the side flap 140 with the section 130. The intersection between the top flap 134 and the side flap 140 (e.g., along fold line 118) abuts the top perimeter of the container 100 and the top flap 134 abuts the top flap 144, thereby providing structural support to the top flap 134. Engagement of the side flap 140 with the section 134 provides additional structural support to the top flap 134.

Once assembled, the side flaps 140, 150 are disposed on opposing sides of the container 100. The side flaps 140, 150 and height of the top flaps 134, 144 are shown as dimensioned a partial width of the wall portions 110, 114, resulting in each top flap 134, 144 covering only a portion of the interior area 128 (see, e.g., FIGS. 6 and 7). In some embodiments, the side flaps 140, 150 and/or the top flaps 134, 144 can be dimensioned substantially similar in width to the wall portions 110, 114 such that each top flap 134, 144 covers substantially the entire interior area 128.

Figure 9:
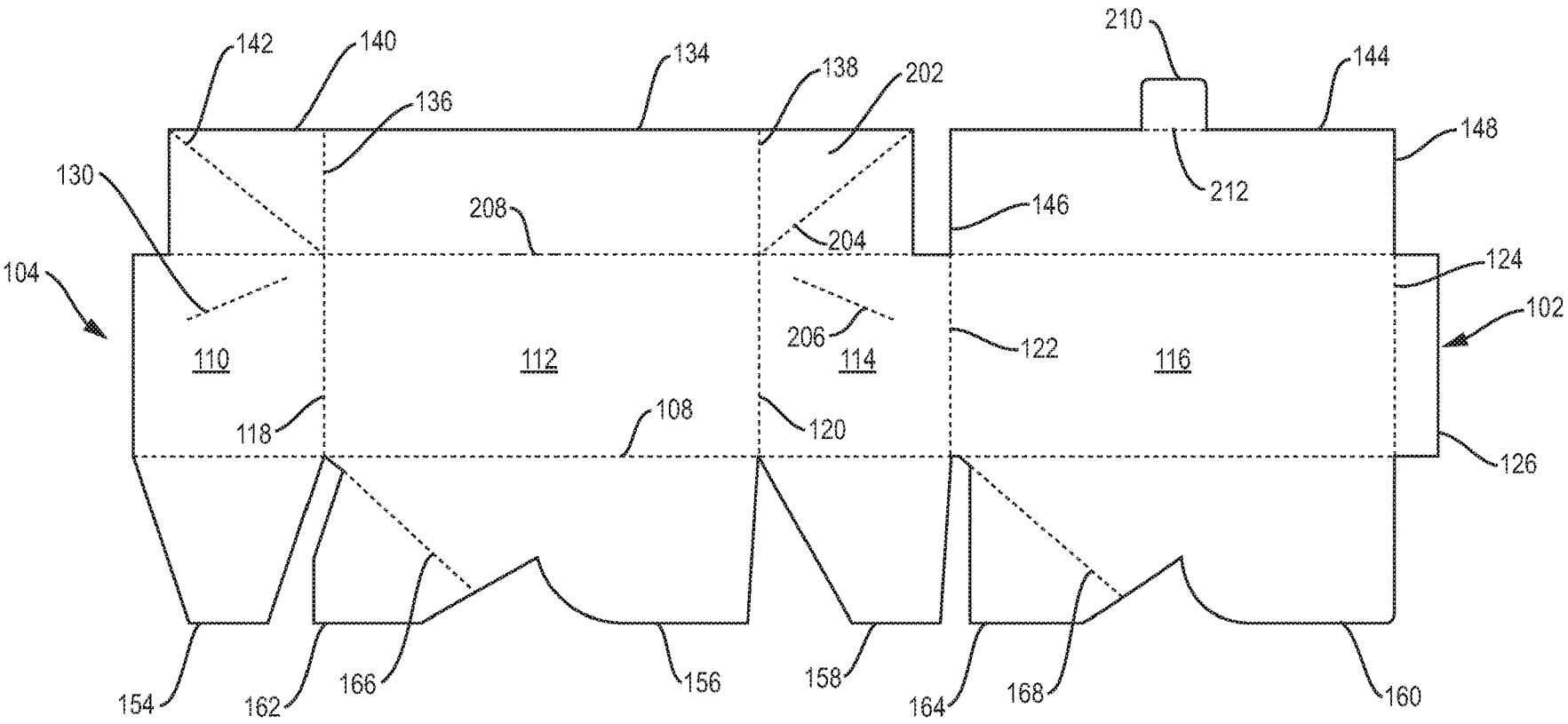
FIG. 9 is diagrammatic view of an exemplary blank for a break pack container of the present disclosure in a collapsed configuration.

FIG. 9 is a schematic diagram of an alternate blank for a break pack container 200 (hereinafter "container 100") of the present disclosure. The container 200 can be substantially similar in structure and function to the container 100, except for the dissentions noted herein. Therefore, same reference numbers are used to refer to same structures. Rather than including a single side flap 140, 150 on each of the top flaps 134, 144, the container 200 includes one top flap 134 with two side flaps 140, 202 on opposing sides, and the other top flap 144 does not include a side flap.

In particular, the container 200 includes a side flap 140 operatively connected to the first end 136 of the top flap 134 and a side flap 202 operatively connected to the second end 138 of the top flap 134 at the fold line 120. In exemplary embodiments, the side flap 202 can be integrally formed with and extend from the top flap 134, where the fold line 120 defines the boundary between the side flap 150 and the top flap 144. The side flap 202 can be a mirror image of the side flap 140, including a diagonal fold line 204 extending from the intersection between the fold lines 106, 122 to the opposing corner of the side flap 202. The container 200 includes a section 206 formed in the wall portion 114. In embodiments where the section 206 extends parallel to the fold line 106, the section 206 can be substantially similar to the section 132. In embodiments where the section 206 is angled relative to the fold line 106, the end of the section 206 closest to the fold line 120 can be closer to the fold line 106 than the opposing end of the section 206.

In some embodiments, the top flap 134 can include a section 208 that can form a cutout or be punched out to form the cutout. The top flap 144 can include a locking tab 210 operatively connected and extending from a fold line 212 at the top perimeter of the top flap 144. The locking tab 210 can be configured to engage with the section 208. During assembly, the top flap 134 is folded over the interior area 128 of the container 200 prior to the top flap 144.

As the top flap 134 is folded over the interior area 128, the side flaps 140, 202 are folded outwardly or inwardly at their respective fold lines 142, 204. Each side flap 140, 202 is folded into a substantially triangular configuration and the end points of the side flaps 140, 202 are interlocked with the respective sections 130, 206. The first and second ends 136, 138 of the top flap 134 abut the top perimeter of the container 200 and the side flaps 140, 202 maintain the position of the top flap 134, thereby providing structural support to the container 200. The top flap 144 is subsequently folded over the top flap 134 and the locking tab 210 is interlocked with the section 208 to maintain the top flap 144 engaged with the top flap 134. Overlapping of the top flaps 134, 144 provides additional structural support to the container 200. Although illustrated as being substantially similar in height, in some embodiments, the height of the top flap 144 can be longer than the height of the top flap 134 (e.g., substantially equal to the width of the wall portions 110, 114).

Figure 10:
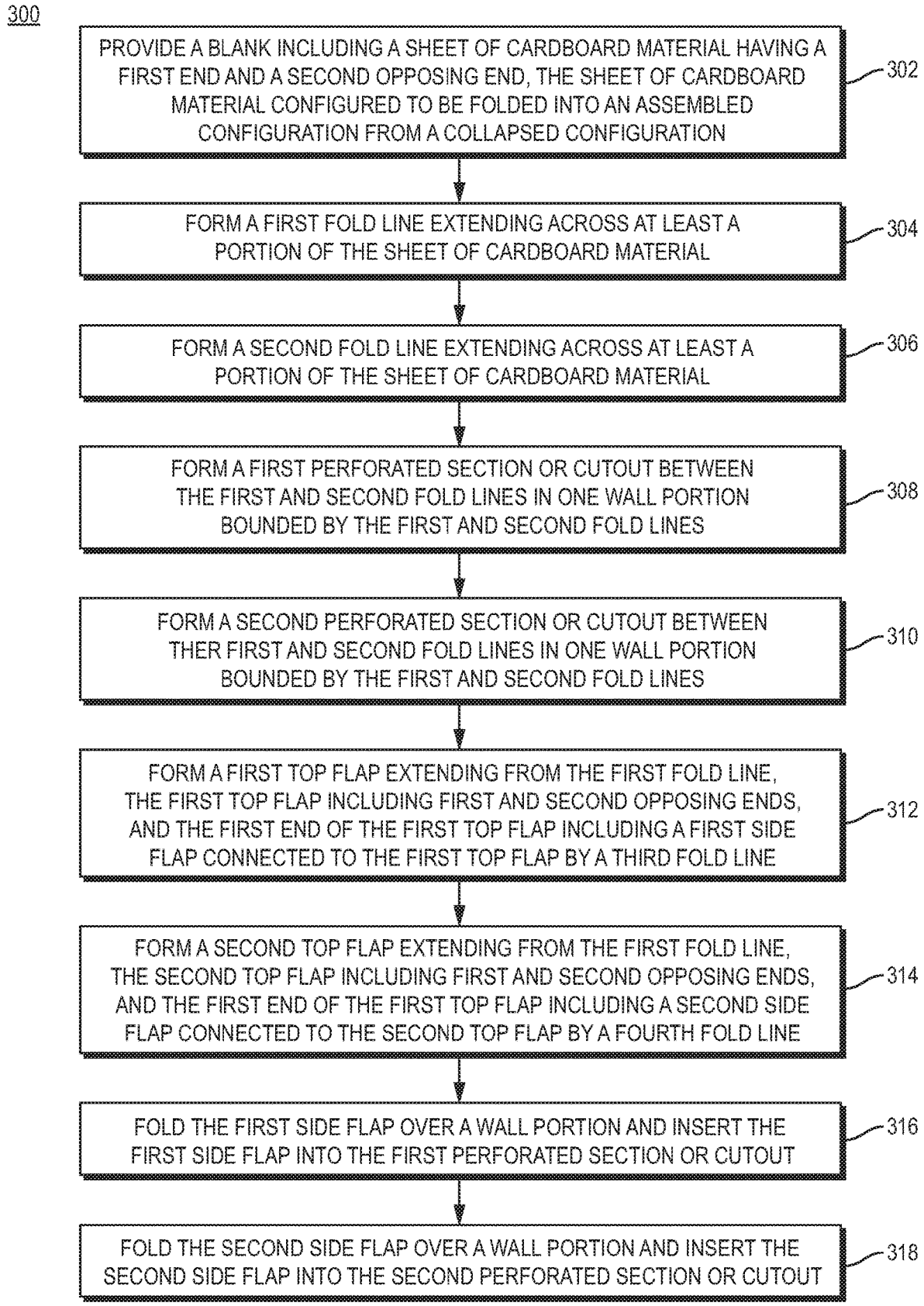
FIG. 10 is a flowchart illustrating an exemplary process of forming a blank for a break pack container in accordance with embodiments of the present disclosure.

FIG. 10 is a flowchart illustrating an exemplary process 300 of forming a blank for a break pack container (e.g., container 100). To begin, at step 302, a blank including a sheet of cardboard material having a first end and a second opposing end is provided. The sheet of cardboard material is configured to be folded into an assembled configuration from a collapsed configuration. At step 304, a first fold line is formed extending across at least a portion of the sheet of cardboard material. At step 306, a second fold line is formed extending across at least a portion of the sheet of cardboard material. At step 308, a first perforated section or cutout is formed between the first and second fold lines in one wall portion bounded by the first and second fold lines. At step 310, a second perforated section or cutout is formed between the first and second fold lines in one wall portion bounded by the first and second fold lines.

At step 312, a first top flap is formed extending from the first fold line. The first top flap includes first and second opposing ends, and the first end of the first top flap includes a first side flap connected to the first top flap by a third fold line. At step 314, a second top flap is formed extending from the first fold line. The second top flap includes first and second opposing ends, and the first end of the first top flap includes a second side flap connected to the first top flap by a fourth fold line. In embodiments of forming the container 200, the second top flap can be formed on the second end of the first top flap. At step 316, the first side flap is folded over a wall portion and inserted into the first perforated section or cutout. At step 318, the second side flap is folded over a wall portion and inserted into the second perforated section or cutout.

Thus, the exemplary containers include top flaps that are capable of providing sufficient structural support to prevent collapse of the top flaps when multiple containers are stacked on top of each other. In particular, the exemplary containers include top flaps with side flaps that interlock with cutouts in the side walls of the container. The overlapping configuration of the top flaps with each other and the side walls, and engagement of the side flaps with the side walls, provides structural stability for the top of the container. Thus, exemplary containers are capable of withstanding greater forces without collapse of the top surface, ensuring protection of the items within the containers.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A blank for a break pack container, comprising:

a sheet of cardboard material having a first end and a second opposing end, the sheet of cardboard material configured to be folded into an assembled configuration from a collapsed configuration, the sheet of cardboard material in the assembled configuration having an interior area;

a first fold line extending across at least a portion of the sheet of cardboard material;

a second fold line extending across at least a portion of the sheet of cardboard material;

wall portions bounded by the first and second fold lines, one of the wall portions including a first perforated section or cutout formed between the first and second fold lines;

a first top flap extending from the first fold line, the first top flap including first and second opposing ends, and the first end of the first top flap including a first side flap connected to the first top flap by a third fold line; and a second top flap extending from the first fold line, the second top flap including first and second opposing ends, a top edge of the second top flap extending between the first and second opposing ends, wherein the first top flap is configured to be folded over at least a portion of the interior area, and the second top flap is configured to be folded over at least a portion of the interior area to overlap the first top flap when the sheet of cardboard material is folded into the assembled configuration;

wherein the first side flap is configured to be folded over a wall portion and inserted into the first perforated section or cutout when the sheet of cardboard material is folded into the assembled configuration; and wherein:

the second top flap is configured to be folded over at least a portion of the interior area to overlap the first top flap along the entire top edge of the second top flap, the first side flap is divided in half by a single diagonal fold line, or the first side flap is connected to the wall portion along the first fold line along an edge of the first side flap, a width of the first side flap is dimensioned smaller than a width of the wall portion at the first fold line.

2. The blank of claim 1, wherein the second fold line is parallel to and spaced from the first fold line.

3. The blank of claim 1, wherein the first and second ends of the sheet of cardboard material are operatively coupled to each other to form a container body with an interior area.

4. The blank of claim 1, wherein one of the wall portions includes a second perforated section or cutout formed between the first and second fold lines.

5. The blank of claim 4, comprising a second side flap connected to the first end of the second top flap by a fourth fold line, wherein the second side flap is configured to be folded over one of the wall portions a wall portion and inserted into the second perforated section or cutout when the sheet of cardboard material is folded into the assembled configuration.

6. The blank of claim 5, wherein in the assembled configuration, the first and second side flaps are disposed on opposing sides of the break pack container.

7. The blank of claim 4, wherein the second end of the first top flap includes a second side flap connected to the first top flap by a fourth fold line, and wherein the second side flap is configured to be folded over one of the wall portions and inserted into the second perorated section or cutout when the sheet of cardboard material is folded into the assembled configuration.

8. The blank of claim 1, wherein the first side flap is connected to the first top flap by the third fold line and connected to the first fold line by a fourth fold line.

9. The blank of claim 1, wherein the first perforated section or cutout is a linear line extends in a non-parallel manner and is angled relative to the first and second fold lines.

10. The blank of claim 1, wherein the overlapping first and second top flaps define a substantially flat top portion of the sheet of cardboard material in the assembled configuration.

11. The blank of claim 1, wherein the first side flap is connected to the first top flap at the third fold line along another edge of the first side flap.

12. A break pack container, comprising:

wall portions that form a container body with an interior area, the wall portions defining a top perimeter and an opposing bottom perimeter, the wall portions including a first side wall with a first perforated section or cutout formed in the first side wall between the top and bottom perimeters, and including a second side wall with a second perforated section or cutout formed in the second side wall between the top and bottom perimeters;

a first top flap extending from the top perimeter, the first top flap including first and second opposing ends, and the first end of the first top flap including a first side flap connected to the first top flap by a first fold line; and a second top flap extending from the top perimeter, the second top flap including first and second opposing ends, a top edge of the second top flap extending between the first and second opposing ends, wherein the first top flap is configured to be folded over at least a portion of the interior area and the second top flap is configured to be folded over at least a portion of the interior area to overlap the first top flap, the first and second top flaps forming a top portion of the break pack container;

wherein the first side flap is configured to be folded over the first side wall and inserted into the first perforated section or cutout to maintain the position of the first top flap; and wherein:

the second top flap is configured to be folded over at least a portion of the interior area to overlap the first top flap along the entire top edge of the second top flap, the first side flap is divided in half by a single diagonal fold line, or the first side flap is connected to the first side wall of the wall portions along the first fold line along an edge of the first side flap, a width of the first side flap is dimensioned smaller than a width of the first side wall at the first fold line.

13. The break pack container of claim 12, comprising a second side flap connected to the first end of the second top flap by a second fold line, wherein the second top flap is configured to be folded over the first top flap, and wherein the second side flap is configured to be folded over the second side wall and inserted into the second perforated section or cutout to maintain the position of the second top flap.

14. The break pack container of claim 13, wherein the first and second side flaps are disposed on opposing sides of the break pack container.

15. The break pack container of claim 12, wherein the second end of the first top flap includes a second side flap connected to the first top flap by a second fold line.

16. The break pack container of claim 15, wherein the second side flap is configured to be folded over the second side wall and inserted into the second perforated section or cutout to maintain the position of the first top flap.

17. The break pack container of claim 12, wherein the first side flap is connected to the first top flap by the first fold line and connected to the top perimeter by a second fold line.

18. A method of forming a blank for a break pack container, comprising:

providing a blank including a sheet of cardboard material having a first end and a second opposing end, the sheet of cardboard material configured to be folded into an assembled configuration from a collapsed configuration, the sheet of cardboard material in the assembled configuration having an interior area;

forming a first fold line extending across at least a portion of the sheet of cardboard material;

forming a second fold line extending across at least a portion of the sheet of cardboard material;

forming a first perforated section or cutout between the first and second fold lines in one wall portion bounded by the first and second fold lines;

forming a first top flap extending from the first fold line, the first top flap including first and second opposing ends, and the first end of the first top flap including a first side flap connected to the first top flap by a third fold line;

forming a second top flap extending from the first fold line, the second top flap including first and second opposing ends, a top edge of the second top flap extending between the first and second opposing ends;

folding the first top flap over at least a portion of the interior area;

folding the second top flap over at least a portion of the interior area to overlap the first top flap; and folding the first side flap over a wall portion and inserting the first side flap into the first perforated section or cutout, wherein:

the second top flap is configured to be folded over at least a portion of the interior area to overlap the first top flap along the entire top edge of the second top flap, the first side flap is divided in half by a single diagonal fold line, or the first side flap is connected to the wall portion along the first fold line along an edge of the first side flap, a width of the first side flap is dimensioned smaller than a width of the wall portion at the first fold line.

* * * * *